US005797437A

United States Patent [19]

Beeson

[11] Patent Number: 5,797,437

[45] Date of Patent: Aug. 25, 1998

[54] LOG PEELER

[76] Inventor: Greg Beeson, P.O. Box 121, Somers, Mont. 59932

[21] Appl. No.: 832,520

[22] Filed: Apr. 3, 1997

[51] Int. Cl.[6] ..... B27L 1/06

[52] U.S. Cl. ..... 144/208.1; 30/121; 30/169; 30/317; 144/208.92; 144/341; 144/363

[58] Field of Search ..... 30/121, 167, 169, 30/314, 315, 317; 144/208.1, 208.6, 208.92, 340, 341, 363

[56] References Cited

U.S. PATENT DOCUMENTS 4,595,041 6/1986 Fox et al. ..... 144/208.5

FOREIGN PATENT DOCUMENTS 1440656 4/1966 France ..... 144/208.92
1218695 6/1966 Germany ..... 144/208.92

*Primary Examiner*—W. Donald Bray

*Attorney, Agent, or Firm*—Harry M. Cross, Jr.

[57] ABSTRACT

A log peeler comprises a log peeling knife assembly 10 attached to a pulling cable 12, the pulling cable 12 being reeved around a powered cable drum 14. The pulling cable is attached at each end of the knife assembly so that the knife assembly will be pulled straight along a longitudinal line perpendicular to the orientation of the knife assembly. The powered cable drum 14 may be an engine or motor driven winch, where the engine or motor is an integral part of the assembly that includes the cable drum. The cable drum 14 is powered by a portable and detachable engine, such as a chain saw assembly 16. A remote control 82 may be located at or near the knife assembly so that the operator can engage or disengage the powered drum, as by closing or opening the chain saw trigger 17 through the action of a controller mechanism 84. Control 82 and controller mechanism 84 may be connected by a power cable or the controller mechanism 84 may be actuated by signals transmitted from control 82 through the air, such as infrared or radio telemetry signals.

17 Claims, 4 Drawing Sheets

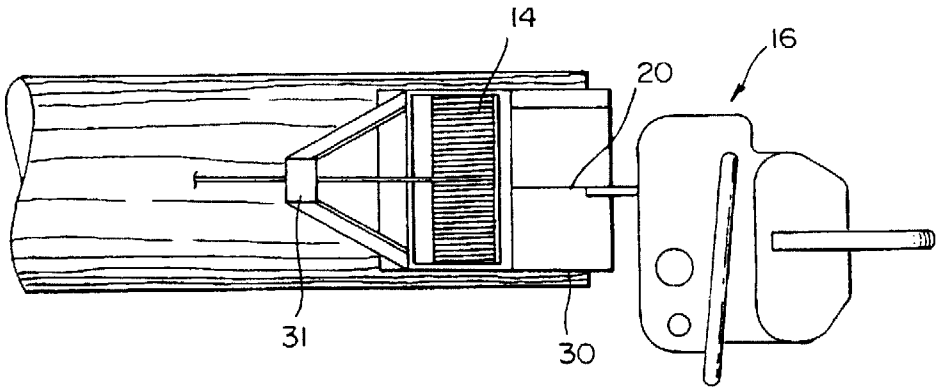
FIG. 4
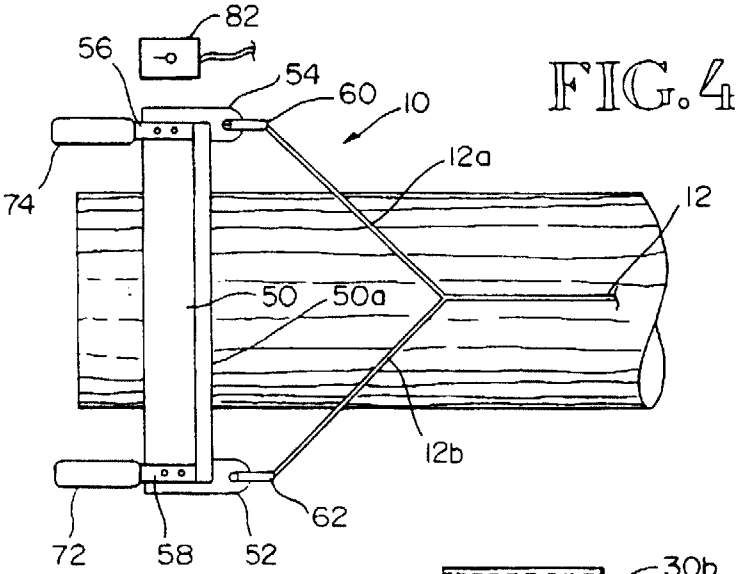
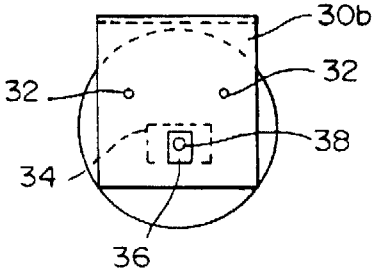
FIG. 5
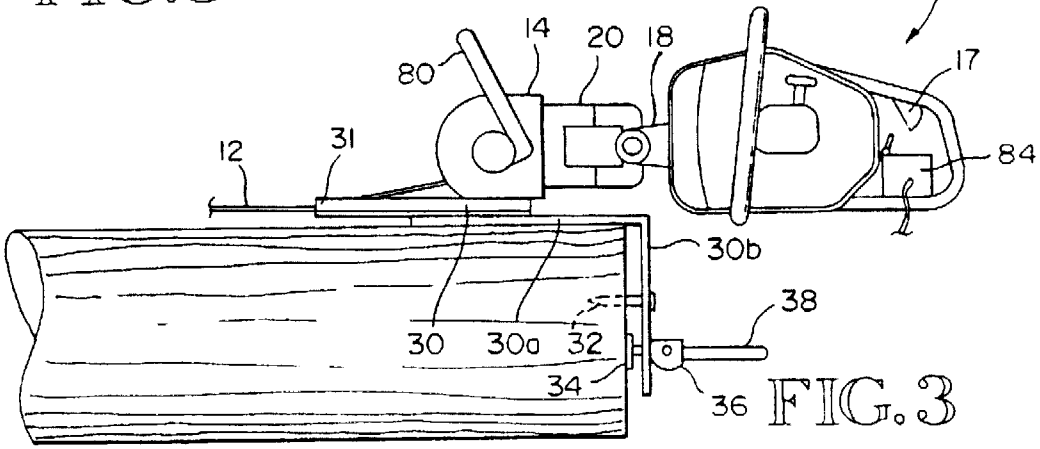
FIG. 3
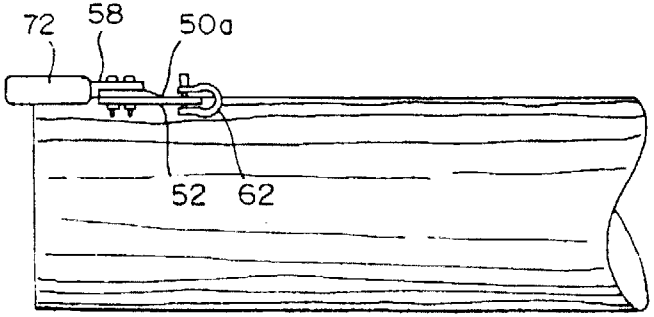

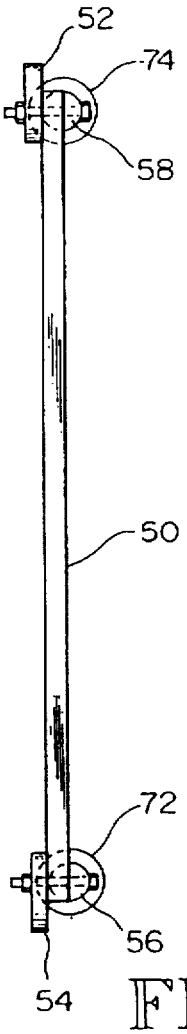
FIG. 9
FIG. 6
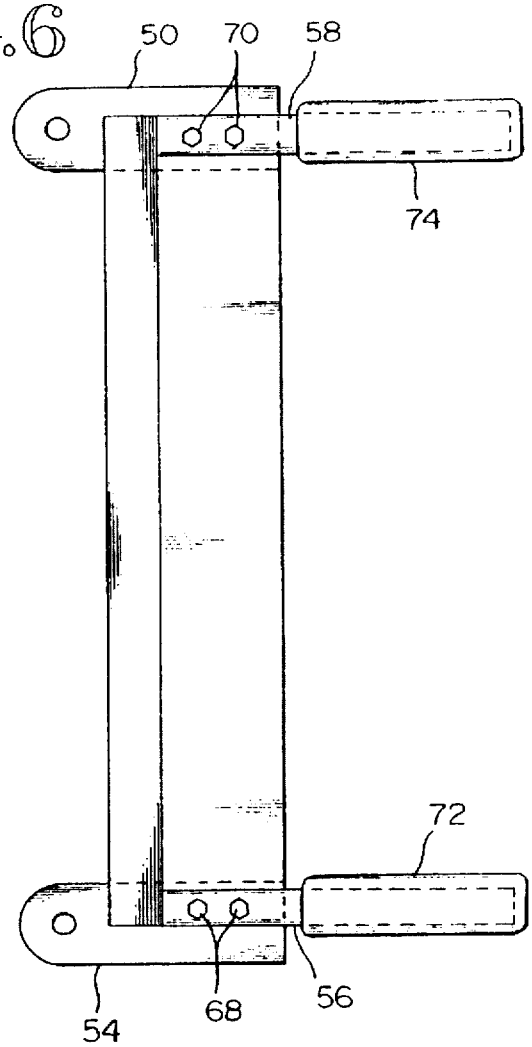
FIG. 8
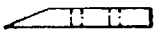
FIG. 7
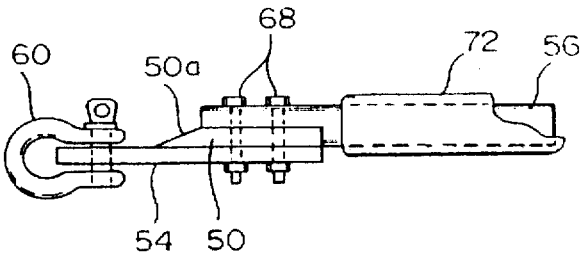

LOG PEELER

BACKGROUND OF THE INVENTION

1. Field of the Invention

This invention related to log peelers and, more particularly, to log peelers designed to be operated by one person with the aid of a powered winch.

2. Brief Description of the Prior Art

Log peeling is an ancient art practiced by individuals to remove bark from logs prior to using the logs in construction buildings and other structures. The art has progressed to the point where complicated machinery is used by lumber companies to debark logs in mass production processes. However, there has been nothing made available to an individual for peeling logs in what might be termed "a back yard operation".

In its oldest forms, a draw knife has been used to peel logs, requiring that a blade having a sharpened end be drawn toward the user to cut into and peel bark from a log, one stroke at a time. This is a time consuming operation and one, for all practical purposes, that is available only to the most dedicated. There has been no mechanized system available for a single person to use that is uncomplicated and inexpensive such that homeowners, small log mill operators, or land owners with small stands of timber could use to provide peeled logs for various uses and for various customers.

SUMMARY OF THE INVENTION

A primary object of this invention is to provide an economical mechanized system that can be used by an individual to peel logs. A further object is to provide such a system that can include commercially available motive forces for powering the system. Another object is to provide such a system incorporating a draw cable and a powered drum to pull a peeler knife along the length of a log. Still another object is to provide such a system where the peeler knife is guided by the individual operator to regulate the depth and extent of the peeling operation. A still further object is to provide such a system that can be employed to shape, or square, a log in addition to peeling the log.

These objects and advantages will become apparent from the following description of the invention.

In accordance with these objects and advantages, the invention comprises a log peeler system comprising a log peeling knife means adapted to be held by an operator and guided by the operator along the surface of a log to debark or shape a log, powered cable drum means including a pulling cable and a cable drum with the pulling cable extending from a cable drum to cable attachment means on the knife means, mounting means for detachably mounting the cable drum means to an end of a log so that winding said pulling cable onto the drum will cause the knife means to be pulled along the log toward the mounting means. The mounting means is constructed and arranged to position and hold the cable drum means near the log when the knife means is pulled along the log. The cable drum means may include chainsaw means operably connected to the cable drum for winding the cable onto the cable drum. The chainsaw means may include clutch means engageable to cause the cable drum to wind the cable onto the cable drum and disengageable to enable the cable drum to free wheel so that the operator may activate the cable drum to pull the knife means along the log and may inactivate the cable drum so as to be able to pull cable from the cable drum when relocating the knife means. Control means are locatable near the knife means for controlling the cable drum means such that cable winding onto the drum can be controlled by the operator near the knife means. The control means comprises a remote control, and controller means located with the chainsaw means are operable to activate the chainsaw means in response to a signal received from the remote control to wind cable onto the cable drum.

BRIEF DESCRIPTION OF THE DRAWINGS

FIG. 3 is a side elevation of a preferred embodiment of the log peeler applies to a log;

FIG. 4 is a top plan view of the set-up shown in FIG. 3;

FIG. 5 is an end view of the log shown in FIG. 3;

FIG. 6 is a top plan view of the log peeling knife assembly incorporated into the FIG. 3 embodiment;

FIG. 7 is an end elevation view of the FIG. 6 log peeling knife assembly;

FIG. 8 is an end elevation view of the knife in the log peeling knife assembly of FIG. 6; and FIG. 9 is a front elevation view of the FIG. 6 log peeling knife assembly.

DESCRIPTION OF THE PREFERRED EMBODIMENT

Figure 1:
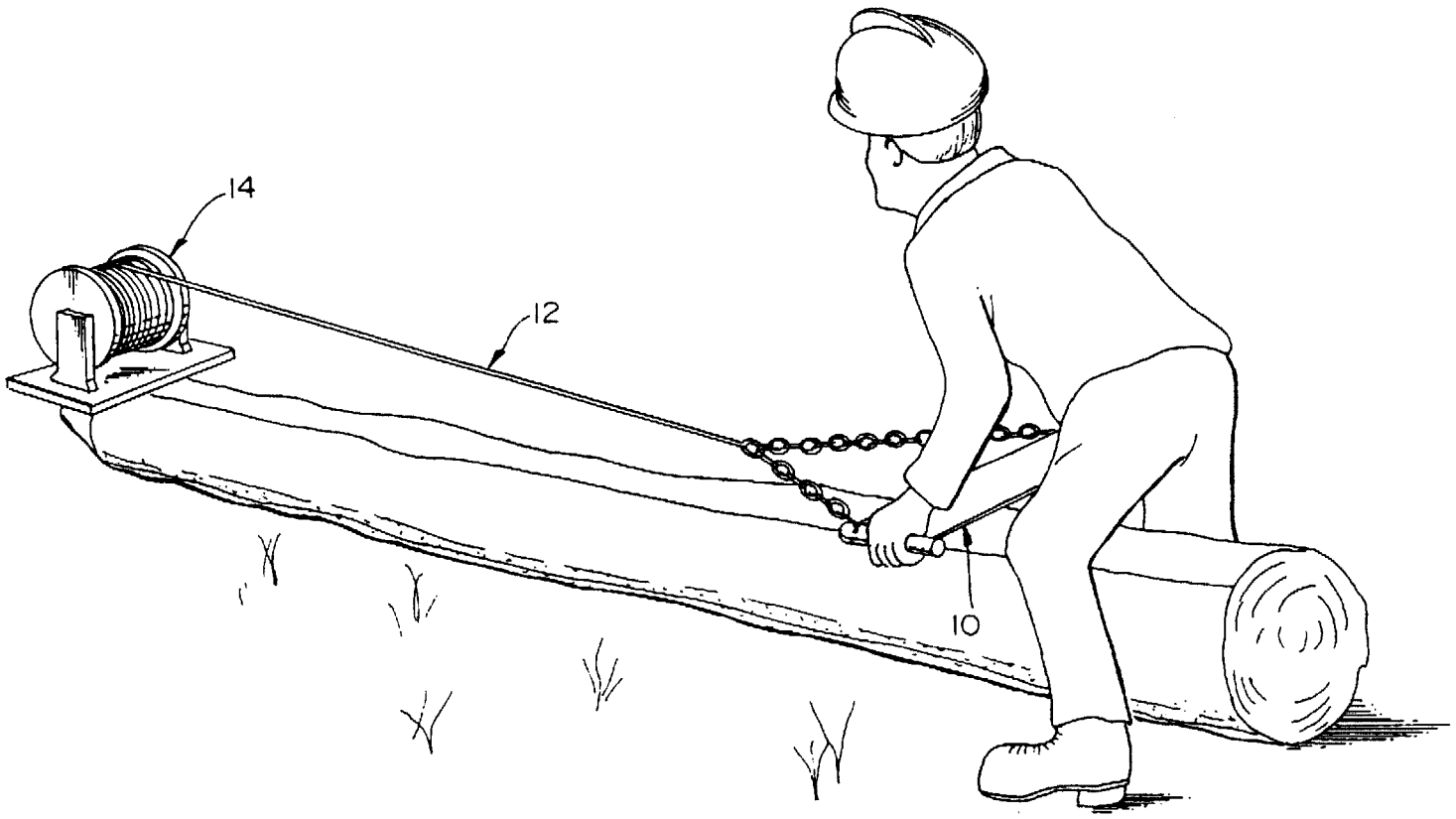
FIG. 1 illustrates the log peeler of this invention applied to a log that is lying on the ground.
Figure 2:
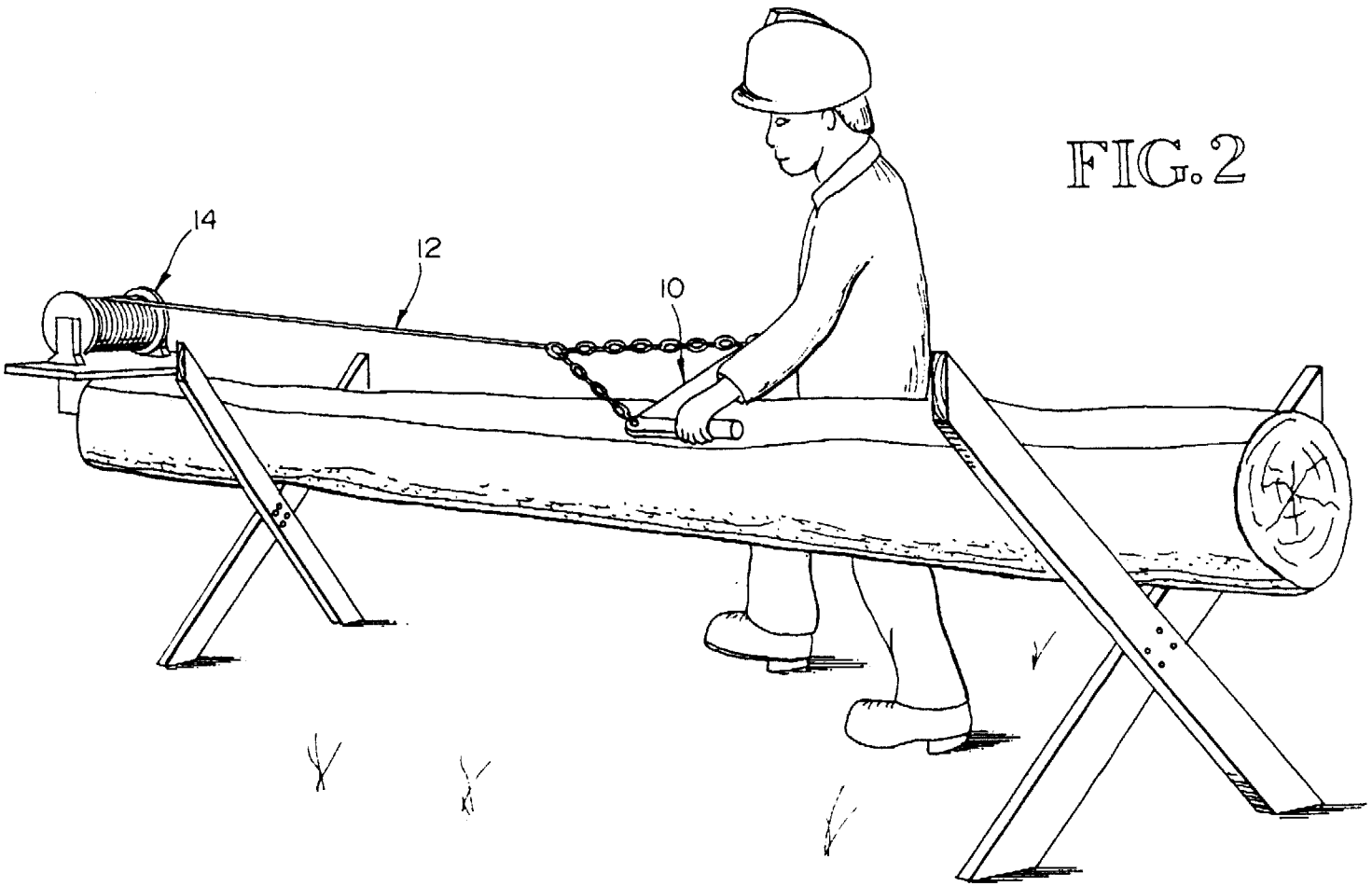
FIG. 2 illustrates the log peeler of this invention applied to a log that is supported in cross-braces.

The log peeler of this invention comprises a log peeling knife assembly 10 attached to a pulling cable 12, the pulling cable 12 being reeved around a powered cable drum 14. The pulling cable may be a link chain, a wire rope, a woven belt or any other similar elongated rope-like element. The pulling cable is attached at each end of the knife assembly so that the knife assembly will be pulled straight along a longitudinal line perpendicular to the orientation of the knife assembly. The powered cable drum 14 may be an engine or motor driven winch, where the engine or motor is an integral part of the assembly that includes the cable drum.

In the preferred embodiment shown in FIG. 3–9, the cable drum 14 is powered by a portable and detachable engine, such as the chain saw assembly 16 shown. In this preferred embodiment, the chain saw cutting chain has been replaced by a link drive chain 18 and the chain saw guide blade has been replaced by an adapter 20 that interconnects the cable drum and the link drive chain so that operation of the chain saw engine 20 will rotate the cable drum so as to reel-in the cable 12. The chain saw assembly 16 is adjustable mounted to the adapter 20 such that the drive chain 18 can be attached to adapter 20 and then drawn taut, and such that the chain saw assembly can be removed from the adapter 20 for reconversion back to a typical chain saw configuration.

The cable drum 14 is preferably mounted to a log mounting bracket 30 that is designed to support the cable drum on top of a log such that the adapter 20 and chain saw assembly 16 can be cantilevered rearward beyond the end of the log. The mounting bracket 30 is designed to be secured to the end of a log in such a way that the pulling force exerted by the cable 12 will not pull the bracket 30 loose from its moorings. The particular configuration shown for bracket 30 includes a horizontal plate **30*a* and a vertical plate 30*b*, plate 30*b* designed to be placed across the end of the log and attached thereto, and plate 30*a* being designed to carry and hold the cable drum 14** in a fixed position once the bracket is attached to the log.

Mounting bracket 30 may include a cable-guiding fairlead 31 that is extended toward the opposite end of the log. As shown in FIGS. 3 and 4, the fairlead 31 positions the cable 12 close to the surface of the log and centers the cable along the top of the log. Consequently, as the cable is reeved in by the cable drum 14, the cable will remain close to the log and also centered on top of the log, even though the run of the cable into the cable drum may wind back and forth across the drum.

The attachment assembly for bracket 30 includes two spikes 32 extending from the inner face of plate **30*b* so that they may be forced into the end of the log. These spikes 32 are placed so that they will resist twisting of the bracket 30 relative to the log. The attachment assembly also includes a clamp assembly comprising a clamp bracket 34 designed to be fastened to the end of the log, a cam 36 rotatably mounted to outer face of plate 30*b*, and a lever 38 connected to the cam 36. The clamp assembly is configured so that pivoting the lever in one direction will cause the cam 36 to bear against the plate 30*b* and urge it toward the log end, and so that pivoting the lever in the other direction will release the cam from forcibly urging the plate 30*b* toward the log end. The spiked plate 30*b* can be set against the log end and the spikes 32 driven into the log end thereby drawing the plate 30*b* toward the log end and securing the clamp bracket 34 against the log end, also. When the plate 30*b* is cammed against the log by operating lever 38, a pulling force exerted by cable 12 will be resisted by the spikes 32 and the clamp bracket 34. This arrangement will prevent the mounting plate 30** from being tipped up on its forward edge or being otherwise shifted out of position.

The peeling knife assembly comprises a peeling knife blade 50, a pair of cable mounting plates, 52 and 54, mounted to the ends of the blade 50, a pair of handles, 56 and 58, mounted to the plates 52 and 54, and a pair of cable attachment rings, 60 and 62, connected to the plates 52 and 54. The blade 50 is a rectangular bar with one edge beveled into a sharpened leading edge **50*a*. The ends of the blade are bored with a pair of bolt holes and the mounting plates 52 and 54 are also bored with bolt holes so that plates can be bolted onto the bottom of the blade as shown in FIG. 7. The leading ends of the mounting plates 52 and 54 are bored to provide fastening holes for cable-connecting devises 60, 62 as shown. The devises are free to move in the fastening holes so that they may be aligned in the direction of the pulling forces exerted by the pulling cable 12. The trailing end of cable 12 is fastened to the devises 60, 62 by cable extensions 12*a* and 12*b*. These extensions may be provided as a "Y" that is fastened to the cable end by a fastening sleeve. The handles 56, 58 project rearwardly of the knife blade 50 and are attached to the ends of the blade 50 by the same bolts 68, 70 that secure the cable mounting plates 52, 54 to the blade, as shown in FIG. 7. The rearward ends of the handles 56, 58 are covered by handle grips 72 and 74**.

The cable mounting plates 52, 54 are located underneath the peeling blade 50. Consequently, the pulling force exerted by cable 50 will tend to pull the blade 50 up out of peeling engagement with the log. The operator, holding the handles 56, 58 will walk along the log, as the cable drum 14 reels in the cable, will tip the blade edge **50*a* down into the bark to the extent desired to perform a peeling, shaping or squaring operation. By this arrangement, the operator has full control of the peeling operation in that the peeling blade 50** will not dig in unless tipped down toward the log by the direction action of the operator.

The cable drum and chain saw assembly will have a mechanism by which the drum can be disengaged so that the cable 12 can be pulled from the drum to return the knife assembly to the opposite end of the log. Typically, the chain saw assembly 16 will have a centrifugal clutch that engages when the chainsaw throttle opens and disengages when the throttle closes. The connection of the chain saw assembly 16 and the cable drum 14 may take advantage of the centrifugal clutch such that when the clutch is disengaged, the cable drum will free wheel until the chain saw throttle is opened. A backlash-preventing mechanism, represented by lever 80, may be provided to prevent unwanted backward spinning of the cable drum 14 when cable is pulled from the drum. A remote control 82 may be located at or near the knife assembly so that the operator can engage or disengage the powered drum, as by closing or opening the chain saw trigger 17 through the action of a controller mechanism 84. Control 82 and controller mechanism 84 may be connected by a power cable or the controller mechanism 84 may be actuated by signals transmitted from control 82 through the air, such as infrared or radio telemetry signals. Control 82 may be as simple as an on-off switch and controller mechanism 84 may be as simple as a solenoid that is mechanically linked to the chainsaw trigger 17 by means of an adjustable actuating rod. Switching control 82 "on" would result in the trigger 17 being depressed and cause the chainsaw to go from idle to full throttle, and switching control 82 "off" would result in the trigger 17 be released and cause the chainsaw to go from full throttle to idle. When in the idle mode, the chainsaw centrifugal clutch would disengage so that the operator could relocate the knife assembly 10, pulling cable off the cable drum 14 as needed. The cable drum anti-backlash mechanism is self-activating to prevent the cable drum 14 from over running the cable and causing a backlash as the operator pulls cable from the drum.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A log peeler system comprising a log peeling knife means adapted to be held by an operator and guided by the operator along the surface of a log to debark or shape a log; powered cable drum means including a pulling cable and a cable drum with said pulling cable extending from a cable drum to cable attachment means on said knife means; mounting means for detachably mounting said cable drum means to an end of a log so that winding said pulling cable onto said drum will cause said knife means to be pulled along the log toward said mounting means, said mounting means being constructed and arranged to position and hold said cable drum means near the log when said knife means is pulled along the log; and control means locatable near said knife means for controlling said cable drum means such that cable winding onto said drum can be controlled by the operator near said knife means.

2. The system of claim 1 wherein said cable drum means includes chainsaw means operably connected to said cable drum for winding said cable onto said cable drum, said chainsaw means including clutch means engageable to cause said cable drum to wind said cable onto said cable drum and disengageable to enable said cable drum to free wheel so that the operator may activate said cable drum to pull said knife means along the log and may inactivate said cable drum so as to be able to pull cable from said cable drum when relocating said knife means.

3. The system of claim 1 wherein said knife means comprises a peeling knife blade and a pair of handles projecting rearwardly from said blade, said blade have a sharpened forward edge; and wherein said cable attachment means comprises a pair of cable mounting plates mounted at the end of said blade and projecting forwardly of said blade such that, when said cable is attached to said cable mounting plates and pulled toward said cable drum, said blade will be oriented cross-wise to the log; said blade, handles and cable mounting plates being so constructed and arranged that the operator may hold said handles and tilt said blade downward to guide said sharpened forward edge inward toward the log and may tilt said blade upward to guide said sharpened forward edge outward away from the log, while said cable is pulling said knife blade toward said cable drum.

4. The system of claim 2 wherein said knife means comprises a peeling knife blade and a pair of handles projecting rearwardly from said blade, said blade have a sharpened forward edge; and wherein said cable attachment means comprises a pair of cable mounting plates mounted at the end of said blade and projecting forwardly of said blade such that, when said cable is attached to said cable mounting plates and pulled toward said cable drum, said blade will be oriented cross-wise to the log; said blade, handles and cable mounting plates being so constructed and arranged that the operator may hold said handles and tilt said blade downward to guide said sharpened forward edge inward toward the log and may tilt said blade upward to guide said sharpened forward edge outward away from the log, while said cable is pulling said knife blade toward said cable drum.

5. The system of claim 3 wherein said cable attachment means includes a pair of cable attachments each connected to a forward end of one of said cable mounting plates, and further includes a cable extension connected to each of said cable attachments and to said cable in a Y-connection so that pulling forces exerted by said cable will be applied to each end of said knife blade.

6. The system of claim 4 wherein said cable attachment means includes a pair of cable attachments each connected to a forward end of one of said cable mounting plates, and further includes a cable extension connected to each of said cable attachments and to said cable in a Y-connection so that pulling forces exerted by said cable will be applied to each end of said knife blade.

7. The system of claim 1 wherein the cable drum mounting means comprises a log mounting bracket adapted to engage an end of the log and be secured thereto, said bracket being further adapted to provide a support for said cable drum means alongside the log adjacent to the log end.

8. The system of claim 7 wherein said mounting bracket includes a cable guide projecting toward said knife means and confining said cable such that said cable extends from said cable drum toward said knife means in close proximity to the log.

9. The system of claim 2 wherein the cable drum mounting means comprises a log mounting bracket adapted to engage an end of the log and be secured thereto, said bracket being further adapted to provide a support for said cable drum means alongside the log adjacent to the log end.

10. The system of claim 9 wherein said mounting bracket includes a cable guide projecting toward said knife means and confining said cable such that said cable extends from said cable drum toward said knife means in close proximity to the log.

11. The system of claim 1 wherein said control means comprises a remote control; and wherein said system includes a controller located with said cable drum means and operable to activate said cable drum means in response to a signal received from said remote control to wind cable onto said cable drum.

12. The system of claim 2 wherein said control means comprises a remote control; and wherein said system includes a controller located with said chainsaw means and operable to activate said chainsaw means in response to a signal received from said remote control to wind cable onto said cable drum.

13. A log peeler system comprising a log peeling knife means adapted to be held by an operator and guided by the operator along the surface of a log to debark or shape a log; powered cable drum means including a pulling cable and a cable drum with said pulling cable extending from a cable drum to cable attachment means on said knife means; said cable drum means including chainsaw means operably connected to said cable drum for winding said cable onto said cable drum, said chainsaw means including clutch means engageable to cause said cable drum to wind said cable onto said cable drum and disengageable to enable said cable drum to free wheel so that the operator may activate said cable drum to pull said knife means along the log and may inactivate said cable drum so as to be able to pull cable from said cable drum when relocating said knife means; mounting means for detachably mounting said cable drum means to an end of a log so that winding said pulling cable onto said drum will cause said knife means to be pulled along the log toward said mounting means, said mounting means being constructed and arranged to position and hold said cable drum means near said log when said knife means is pulled along said log; control means locatable near said knife means for controlling said cable drum means such that cable winding onto said drum can be controlled by the operator near said knife means, said control means comprising a remote control; and controller means located with said chainsaw means and operable to activate said chainsaw means in response to a signal received from said remote control to wind cable onto said cable drum.

14. The system of claim 13 wherein said knife means comprises a peeling knife blade and a pair of handles projecting rearwardly from said blade, said blade have a sharpened forward edge; and wherein said cable attachment means comprises a pair of cable mounting plates mounted at the end of said blade and projecting forwardly of said blade such that, when said cable is attached to said cable mounting plates and pulled toward said cable drum, said blade will be oriented cross-wise to the log; said blade, handles and cable mounting plates being so constructed and arranged that the operator may hold said handles and tilt said blade downward to guide said sharpened forward edge inward toward the log and may tilt said blade upward to guide said sharpened forward edge outward away from the log, while said cable is pulling said knife blade toward said cable drum.

15. The system of claim 14 wherein said cable attachment means includes a pair of cable attachments each connected to a forward end of one of said cable mounting plates, and further includes a cable extension connected to each of said cable attachments and to said cable in a Y-connection so that pulling forces exerted by said cable will be applied to each end of said knife blade.

16. The system of claim 13 wherein the cable drum mounting means comprises a log mounting bracket adapted to engage an end of the log and be secured thereto, said bracket being further adapted to provide a support for said cable drum means alongside the log adjacent to the log end.

17. The system of claim 16 wherein said mounting bracket includes a cable guide projecting toward said knife means and confining said cable such that said cable extends from said cable drum toward said knife means in close proximity to the log.

* * * * *